US009784177B2

(12) United States Patent
Choi et al.

(10) Patent No.: US 9,784,177 B2
(45) Date of Patent: Oct. 10, 2017

(54) ENGINE SYSTEM

(71) Applicant: Hyundai Motor Company, Seoul (KR)

(72) Inventors: Byong Young Choi, Bucheon-si (KR); Soo Hyung Woo, Yongin-si (KR); Seung Kook Han, Seoul (KR); Byeong Seok Lee, Hwaseong-si (KR); Wootae Kim, Anyang-si (KR)

(73) Assignee: Hyundai Motor Campany, Seoul (KR)

( * ) Notice: Subject to any disclaimer, the term of this patent is extended or adjusted under 35 U.S.C. 154(b) by 82 days.

(21) Appl. No.: 14/811,602

(22) Filed: Jul. 28, 2015

(65) Prior Publication Data

US 2016/0108860 A1 Apr. 21, 2016

(30) Foreign Application Priority Data

Oct. 21, 2014 (KR) ..... 10-2014-0142798

(51) Int. Cl.

| | |
|---|---|
| ***F02B 25/14*** | (2006.01) |
| ***F02M 26/14*** | (2016.01) |
| ***F02M 26/41*** | (2016.01) |
| *F01N 13/10* | (2010.01) |
| *F02B 37/18* | (2006.01) |

(Continued)

(52) U.S. Cl.

CPC ..... *F02B 25/145* (2013.01); *F02M 26/14* (2016.02); *F02M 26/41* (2016.02); *F01N 5/04* (2013.01); *F01N 13/107* (2013.01); *F02B 37/18* (2013.01); *F02M 26/07* (2016.02); *F02M 26/23* (2016.02); *F02M 26/44* (2016.02)

(58) Field of Classification Search

CPC ..... F02M 25/0719; F02M 25/0709; F02M 25/0726; F02M 25/0744; F02M 25/0788; F02M 25/145

See application file for complete search history.

(56) References Cited

U.S. PATENT DOCUMENTS 6,742,506 B1 * 6/2004 Grandin ..... F02B 37/00 123/568.12
2006/0157009 A1 * 7/2006 Gaessler ..... F01L 9/02 123/90.11

(Continued)

FOREIGN PATENT DOCUMENTS

JP 2004-251201 A 9/2004
JP 2010-24974 A 2/2010

(Continued)

OTHER PUBLICATIONS

JP 2010024974, Machine Translation, Translated on Jan. 17, 2016.*
JP 2010255603, Machine Translation, Translated on Jan. 17, 2016.*

*Primary Examiner* — Patrick Maines
(74) *Attorney, Agent, or Firm* — Morgan, Lewis & Bockius LLP

(57) ABSTRACT

An engine system may include main exhaust ports fluidly communicated with each combustion chamber, main exhaust valves opening and closing each main exhaust port, a main exhaust manifold connected with the main exhaust ports, scavenge exhaust ports fluidly communicated with the each combustion chamber, scavenge valves opening and closing the each scavenge exhaust port, a scavenge manifold connected with the scavenge exhaust ports, in which at least a part of an exhaust gas passing through the scavenge manifold is re-circulated to the combustion chamber to be burned.

6 Claims, 4 Drawing Sheets

(51) Int. Cl.

| | |
|---|---|
| *F02M 26/07* | (2016.01) |
| *F02M 26/23* | (2016.01) |
| *F02M 26/44* | (2016.01) |
| *F01N 5/04* | (2006.01) |

(56) References Cited

U.S. PATENT DOCUMENTS

| | | | | |
|---|---|---|---|---|
| 2011/0167815 | A1* | 7/2011 | Ulrey | F02D 13/0249 60/602 |
| 2012/0060492 | A1* | 3/2012 | Pursifull | F02D 13/0249 60/602 |
| 2013/0340727 | A1* | 12/2013 | Keating | F02M 26/41 123/568.11 |
| 2013/0340728 | A1* | 12/2013 | Keating | F02D 13/0249 123/568.11 |
| 2014/0069082 | A1* | 3/2014 | Alger, II | F02M 26/43 60/274 |
| 2016/0369709 | A1* | 12/2016 | Choi | F02D 13/0276 |

FOREIGN PATENT DOCUMENTS

| | | | | |
|---|---|---|---|---|
| JP | 2010024974 | A | * | 2/2010 |
| JP | 2010-255603 | A | | 11/2010 |
| JP | 2010255603 | A | * | 11/2010 |
| JP | 2011-196196 | A | | 10/2011 |
| JP | 2011196196 | A | * | 10/2011 |
| JP | 2014-98324 | A | | 5/2014 |
| KR | 10-2013-0003115 | A | | 1/2013 |

* cited by examiner

ENGINE SYSTEM

CROSS-REFERENCE TO RELATED APPLICATION

The present application claims priority to Korean Patent Application No. 10-2014-0142798 filed Oct. 21, 2014, the entire contents of which is incorporated herein for all purposes by this reference.

BACKGROUND OF THE INVENTION

Field of the Invention

The present invention relates to an engine system. More particularly, the present invention relates to an engine system which may reduce unburned gas.

Description of Related Art

Since environmental problem has been rising, regulations for vehicle exhaust gas have been reinforced.

Vehicle industries focus on an exhaust system to reduce harmful elements in exhaust gas, to reduce unburned gas and to improve fuel consumption.

General engines include two intake valves and two exhaust valves and the exhaust gases exhausted from the two exhaust valves are joined at one exhaust port. Thus reducing unburned gas within the exhaust gas is limited.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine system which may reduce unburned gas.

According to various aspects of the present invention, an engine system may include main exhaust ports fluidly communicated with each combustion chamber, main exhaust valves opening and closing each main exhaust port, a main exhaust manifold connected with the main exhaust ports, scavenge exhaust ports fluidly communicated with the each combustion chamber, scavenge valves opening and closing the each scavenge exhaust port, a scavenge manifold connected with the scavenge exhaust ports, in which at least a part of an exhaust gas passing through the scavenge manifold is re-circulated to the combustion chamber to be burned.

The scavenge valve may be configured to be opened later than an opening time of the main exhaust valve and configured to be closed later than a closing time of the main exhaust valve.

A valve lift and a valve duration of the scavenge valve may be less than a valve lift and a valve duration of the main exhaust valve.

The valve duration of the scavenge valve may be less than 140 degrees.

A lift where valve profiles of the scavenge valve and the main exhaust valve are crossed may be less than 2.0 mm.

A lift where valve profiles of the scavenge valve and an intake valve are crossed may be more than 80% of a maximum lift of the scavenge valve.

The engine system may further include a turbocharger, in which exhaust gas passing through the main exhaust manifold may pass through a turbine of the turbo charger, and the part of the exhaust gas passing through the scavenge manifold may pass through a compressor of the turbo charger before being supplied to the combustion chamber.

The engine system may further include an EGR cooler, in which the part of the exhaust gas passing through the scavenge manifold may pass through the EGR cooler before being supplied to the combustion chamber.

A diameter of the scavenge exhaust port may be less than a diameter of the main exhaust port.

According to various aspects of the present invention, an engine system may further include main exhaust ports fluidly communicated with each combustion chamber, main exhaust valves opening and closing each main exhaust port, a main exhaust manifold connected with the main exhaust ports, scavenge exhaust ports fluidly communicated with each combustion chamber, scavenge valves opening and closing each scavenge exhaust port, and a scavenge manifold connected with the scavenge exhaust ports, in which exhaust gas passing through the scavenge manifold may be re-circulated to the combustion chamber to be burned.

According to various embodiments of the present invention, the engine system may reduce unburned gas.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
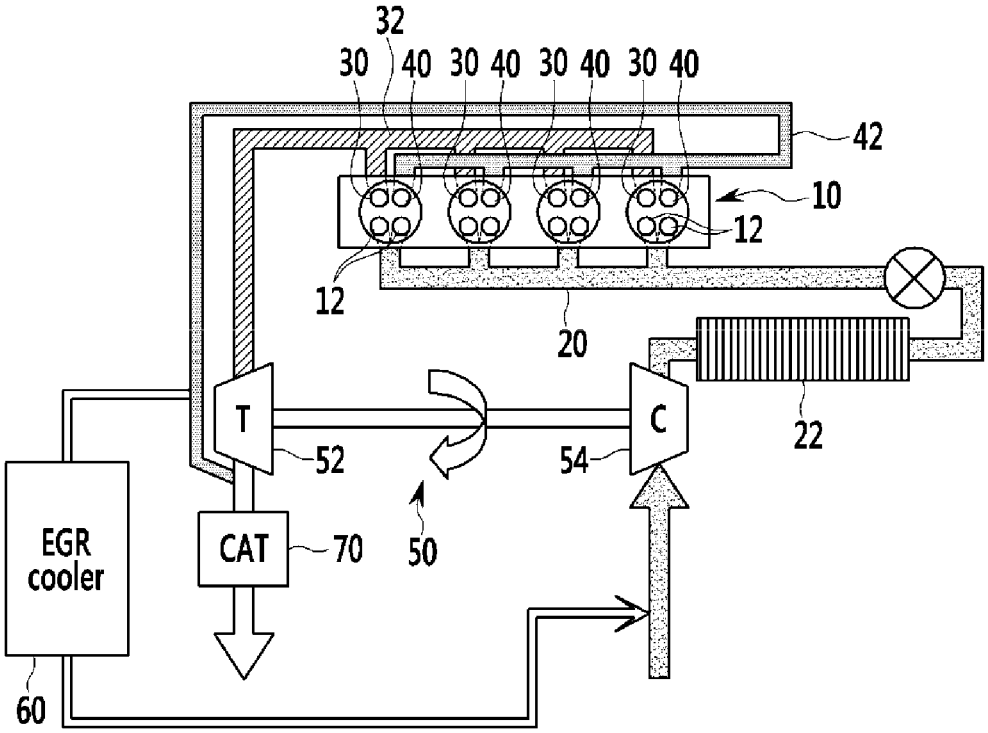
FIG. 1 is a schematic diagram of an exemplary engine system according to the present invention.
Figure 4:
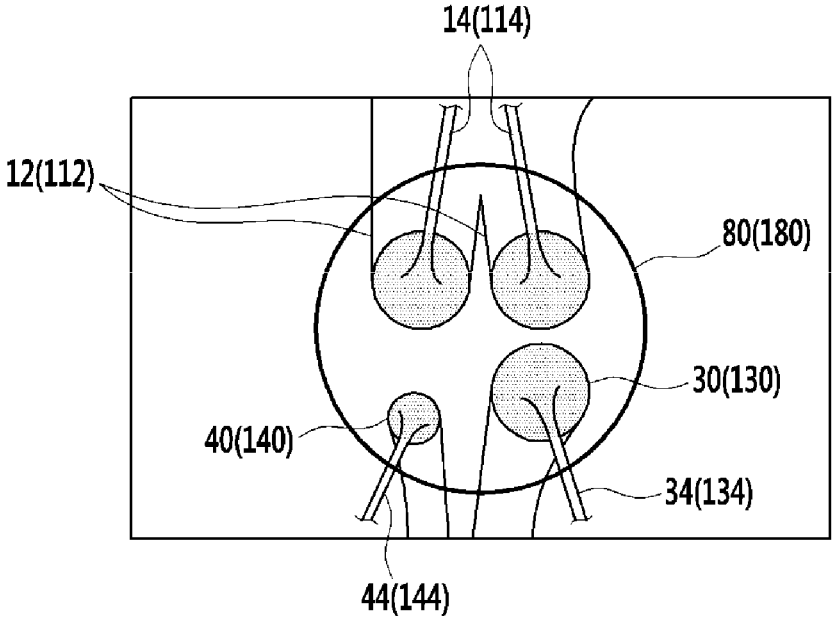
FIG. 4 is a drawing showing intake ports and exhaust ports of an exemplary engine system according to the present invention.

FIG. 1 is a schematic diagram of an engine system according to various embodiments of the present invention and FIG. 4 is a drawing showing intake ports and exhaust ports of an engine system according to various exemplary embodiments of the present invention.

Referring to FIG. 1 and FIG. 4, an engine system according to various embodiments of the present invention includes main exhaust ports 30 communicated with each combustion chamber 80 of an engine 10, main exhaust valves 34 opening and closing the each main exhaust port 30, a main exhaust manifold 32 connected with the main exhaust ports 30, scavenge exhaust ports 40 communicated with the each combustion chamber 80, scavenge valves 44 opening and closing the each scavenge exhaust port 40 and a scavenge manifold 42 connected with the scavenge exhaust ports 40.

Air passing through a charge air cooler 22 is supplied to the combustion chamber 80 through an intake manifold 20 and intake ports 12, exhaust gas passing through the combustion chamber 80 is exhausted through the main exhaust manifold 32, and at least a part of the exhaust gas passing through the scavenge manifold 42 is re-circulated to the combustion chamber 80 to be burned.

Intake valves 14 are disposed on the intake port 12 to control air flow.

The engine system may further include a turbocharger 50, the exhaust gas passing through the main exhaust manifold 32 passes through a turbine 52 of the turbo charger 50, and the part of the exhaust gas passing through the scavenge manifold 42 passes through a compressor 54 of the turbo charger 50 and then is supplied to the combustion chamber 80 with fresh air supplied into the combustion chamber 80 and the other exhaust gas passing through the scavenge manifold 42 may be exhausted to the outside.

The engine system may further include an EGR cooler 60, and the part of the exhaust gas passing through the scavenge manifold 42 passes through the EGR cooler 60 and then is supplied to the combustion chamber 80.

The other exhaust gas passing through the scavenge manifold 42 and the exhaust gas passing through the main exhaust manifold 32 pass through a catalyst 70 to be cleaned and then are exhausted.

Figure 2:
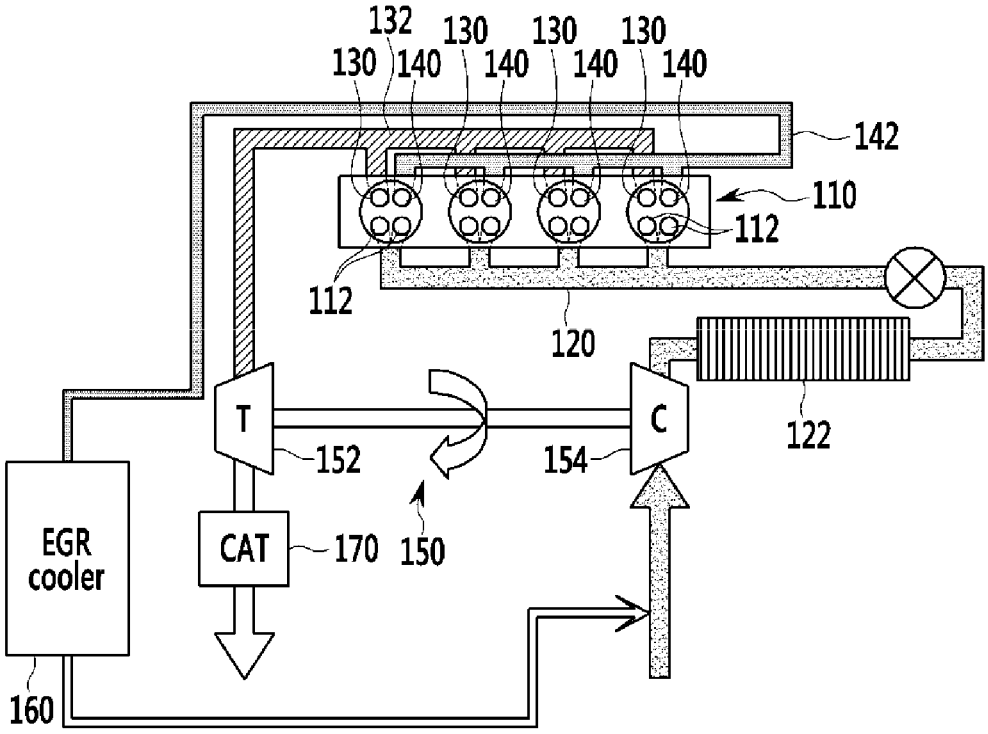
FIG. 2 is a schematic diagram of an exemplary engine system according to the present invention.

Referring to FIG. 2 and FIG. 4, an engine system according to various embodiments of the present invention includes main exhaust ports 130 communicated with each combustion chamber 180 of an engine 110, main exhaust valves 134 opening and closing the each main exhaust port 130, a main exhaust manifold 132 connected with the main exhaust ports 130, scavenge exhaust ports 140 communicated with the each combustion chamber 180, scavenge valves 144 opening and closing the each scavenge exhaust port 140 and a scavenge manifold 142 connected with the scavenge exhaust ports 140.

Air passing through a charge air cooler 122 is supplied to the combustion chamber 180 through an intake manifold 120 and intake ports 112, exhaust gas passing through the combustion chamber 180 is exhausted through the main exhaust manifold 132, and exhaust gas passing through the scavenge manifold 142 is re-circulated to the combustion chamber 180 to be burned.

Intake valves 114 are disposed to the intake port 112 to control air flow.

The engine system may further include a turbocharger 150, the exhaust gas passing through the main exhaust manifold 132 passes through a turbine 152 of the turbo charger 150, and the exhaust gas passing through the scavenge manifold 142 passes through a compressor 154 of the turbo charger 150 and then is supplied to the combustion chamber 180 with fresh air supplied into the combustion chamber 180.

The engine system may further include an EGR cooler 160, and the exhaust gas passing through the scavenge manifold 142 passes through the EGR cooler 160 and then is supplied to the combustion chamber 180.

The exhaust gas passing through the main exhaust manifold 32 passes through a catalyst 70 to be cleaned and then are exhausted.

Figure 3:
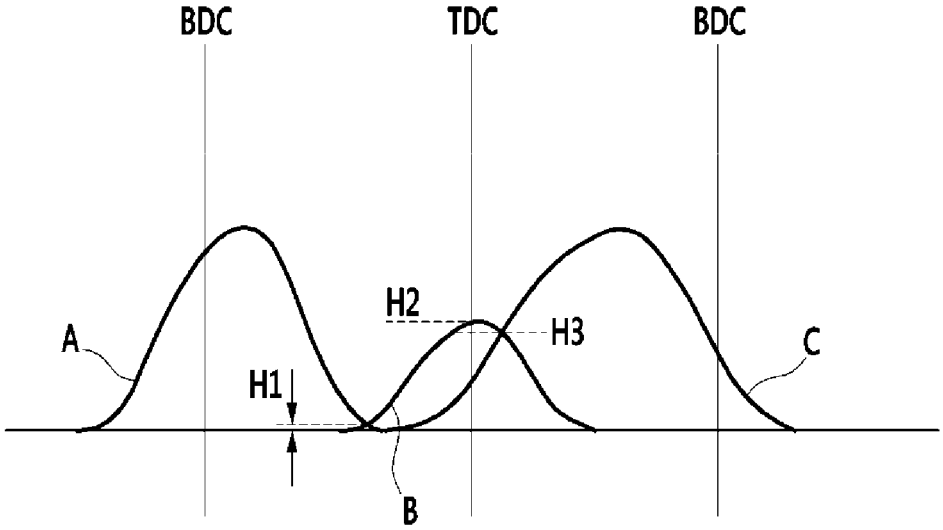
FIG. 3 is a graph of valve profiles of an exemplary engine system according to the present invention.

FIG. 3 is a graph of valve profiles of an engine system according to various embodiments of the present invention.

In FIG. 3, "A" denotes a valve profile of the main exhaust valves 34 and 134, "B" denotes a valve profile of the scavenge valves 44 and 144, and "C" denotes a valve profile of the intake valves 14 and 114.

As shown in FIG. 3, the scavenge valve 44 and 144 is opened later than opening time of the main exhaust valve 34 and 134 and is closed later than closing time of the main exhaust valve 34 and 134.

In blow-down at exhaust stroke, high temperature and high pressure exhaust gas is exhausted, and then relatively low temperature and low pressure exhaust gas (so-called as scavenge) is exhausted.

In scavenge, a relatively large amount of unburned gas is contained in the exhaust gas, and particularly the much unburned gas is exhausted at a valve overlap moment when an intake valve and an exhaust valve are simultaneously opened.

Because air-fuel mix may remain in crevice volumes such as a piston ring groove and the like and it is exhausted as unburned gas at the end of exhaust stroke, that is in scavenge. Thus, a relatively large amount of the unburned gas is contained in scavenge.

In the various embodiments of the present invention, a large amount of unburned gas which may be generated in valve overlap is re-circulated to be re-burned. And thus, harmful elements in the exhaust gas may be reduced and fuel consumption efficiency may be improved.

As shown in FIG. 3, a valve lift and a valve duration of the scavenge valve 44 and 144 is less than that of the main exhaust valve 34 and 134.

For example, the valve duration of the scavenge valve 44 and 144 is less than 140 degree relatively less than that of the main exhaust valve 34 and 134.

A lift H1 where valve profiles of the scavenge valve 44 and 144 and the main exhaust valve 34 and 134 are crossed is less than 2.0 mm. By reducing simultaneous opening time of the scavenge valve 44 and 144 and the main exhaust valve 34 and 134, mutual interference of the scavenge valve 44 and 144 and the main exhaust valve 34 and 134 may be lessened.

A lift H3 where valve profiles of the scavenge valve 44 and 144 and an intake valve 14 and 144 are crossed is more than 80% of a maximum lift H2 of the scavenge valve 44 and 144. By increasing simultaneous opening time of the scavenge valve 44 and 144 and the intake valve 14 and 144, re-circulation of the unburned gas may be enhanced.

FIG. 4 is a drawing showing intake ports and exhaust ports of an engine system according to various embodiments of the present invention.

A diameter of the scavenge exhaust port 40 and 140 is less than a diameter of the main exhaust port 30 and 130. Thus, exhaust resistance may be lessened and engine performance may be improved.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine system comprising:

main exhaust ports fluidly communicated with each combustion chamber;

main exhaust valves opening and closing each main exhaust port;

a main exhaust manifold connected with the main exhaust ports;

scavenge exhaust ports fluidly communicated with the each combustion chamber;

scavenge valves opening and closing the each scavenge exhaust port;

a scavenge manifold connected with the scavenge exhaust ports, wherein at least a part of an exhaust gas passing through the scavenge manifold is re-circulated to the combustion chamber to be burned, wherein the scavenge valve is configured to be opened later than an opening time of the main exhaust valve and configured to be closed later than a closing time of the main exhaust valve, wherein a valve lift and a valve duration of the scavenge valve is less than a valve lift and a valve duration of the main exhaust valve, wherein the valve duration of the scavenge valve is less than 140 degrees, wherein a lift where valve profiles of the scavenge valve and the main exhaust valve are crossed is less than 2.0 mm, wherein a lift where valve profiles of the scavenge valve and an intake valve are crossed is more than 80% of a maximum lift of the scavenge valve, and a turbocharger, wherein exhaust gas passing through the main exhaust manifold passes through a turbine of the turbo charger, and the part of the exhaust gas passing through the scavenge manifold passes through a compressor of the turbo charger before being supplied to the combustion chamber.

2. The engine system of claim 1, further comprising an EGR cooler, wherein the part of the exhaust gas passing through the scavenge manifold passes through the EGR cooler before being supplied to the combustion chamber.

3. The engine system of claim 1, wherein a diameter of the scavenge exhaust port is less than a diameter of the main exhaust port.

4. An engine system comprising:

main exhaust ports fluidly communicated with each combustion chamber;

main exhaust valves opening and closing each main exhaust port;

a main exhaust manifold connected with the main exhaust ports;

scavenge exhaust ports fluidly communicated with each combustion chamber;

scavenge valves opening and closing each scavenge exhaust port;

a scavenge manifold connected with the scavenge exhaust ports, wherein exhaust gas passing through the scavenge manifold is re-circulated to the combustion chamber to be burned, wherein the scavenge valve is configured to be opened later than an opening time of the main exhaust valve and configured to be closed later than a closing time of the main exhaust valve, wherein a valve lift and a valve duration of the scavenge valve is less than a valve lift and a valve duration of the main exhaust valve, wherein the valve duration of the scavenge valve is less than 140 degrees, wherein a lift where valve profiles of the scavenge valve and the main exhaust valve are crossed is less than 2.0 mm, wherein a lift where valve profiles of the scavenge valve and an intake valve are crossed is more than 80% of a maximum lift of the scavenge valve, and a turbocharger, wherein exhaust gas passing through the main exhaust manifold passes through a turbine of the turbo charger, and the exhaust gas passing through the scavenge manifold passes through a compressor of the turbo charger before being supplied to the combustion chamber.

5. The engine system of claim 4, further comprising an EGR cooler, wherein the exhaust gas passing through the scavenge manifold passes through the EGR cooler before being supplied to the combustion chamber.

6. The engine system of claim 4, wherein a diameter of the scavenge exhaust port is less than a diameter of the main exhaust port.

* * * * *